US011298604B1

(12) United States Patent
Lagree et al.

(10) Patent No.: US 11,298,604 B1
(45) **Date of Patent: *Apr. 12, 2022**

(54) EXERCISE MACHINE ACCESSORY SYSTEM

(71) Applicant: Lagree Technologies, Inc., Chatsworth, CA (US)

(72) Inventors: Sebastien Anthony Louis Lagree, Chatsworth, CA (US); Andy H. Gibbs, Tucson, AZ (US)

(73) Assignee: Lagree Technologies, Inc., Chatsworth, CA (US)

( * ) Notice: Subject to any disclaimer, the term of this patent is extended or adjusted under 35 U.S.C. 154(b) by 101 days.

This patent is subject to a terminal disclaimer.

(21) Appl. No.: 17/001,014

(22) Filed: Aug. 24, 2020

Related U.S. Application Data

(63) Continuation of application No. 15/792,336, filed on Oct. 24, 2017, now Pat. No. 10,751,600.
(Continued)

(51) Int. Cl.
*A63B 21/00* (2006.01)
*A63B 21/02* (2006.01)
(Continued)

(52) U.S. Cl.
CPC ..... *A63B 71/00* (2013.01); *A63B 21/00043* (2013.01); *A63B 71/0622* (2013.01); *A63B 21/023* (2013.01); *A63B 21/0428* (2013.01); *A63B 21/0552* (2013.01); *A63B 21/068* (2013.01); *A63B 21/4034* (2015.10); *A63B 21/4035* (2015.10); *A63B 21/4045* (2015.10); *A63B 22/0023* (2013.01);
(Continued)

(58) Field of Classification Search
CPC ..... A63B 22/0023; A63B 21/068; A63B 21/0552; A63B 21/023; A63B 21/4035; A63B 21/4045; A63B 21/0428; A63B 71/00; A63B 21/00043; A63B 71/0622; A63B 21/4034; A63B 2230/045; A63B 2225/682; A63B 2225/68; A63B 2220/30; A63B 2208/0295; A63B 2208/0252; A63B 2208/0247; A63B 2208/0219; A63B 23/1209; A63B 23/0405; A63B 23/03525; A63B 23/0233; A63B 23/0216; A63B 23/0211; A63B 22/20; A63B 22/0087
See application file for complete search history.

(56) References Cited

U.S. PATENT DOCUMENTS 1,621,477 A 8/1925 Pilates
3,770,267 A 11/1973 McCarthy
(Continued)

FOREIGN PATENT DOCUMENTS

WO 2004/096376 A1 11/2004

*Primary Examiner* — Andrew S Lo
(74) *Attorney, Agent, or Firm* — Neustel Law Offices

(57) ABSTRACT

An exercise machine accessory system for facilitating exerciser rehydration during a workout and antibacterial machine wipe down. The exercise machine accessory system generally includes an exercise machine having a first end and a second end, first and second stationary exercise platforms, a movable carriage movably positioned upon a rail, a biasing member connected to the movable carriage, first and second handle assemblies connected to the frame of the exercise machine, a first bottle holder, a first antibacterial wipes dispenser and/or a first disposal receptacle connected to the first right handle assembly or the first left handle assembly.

20 Claims, 14 Drawing Sheets

Related U.S. Application Data

(60) Provisional application No. 62/412,369, filed on Oct. 25, 2016.

(51) Int. Cl.

| | |
|---|---|
| ***A63B 22/00*** | (2006.01) |
| ***A63B 23/02*** | (2006.01) |
| ***A63B 21/055*** | (2006.01) |
| ***A63B 23/035*** | (2006.01) |
| ***A63B 23/12*** | (2006.01) |
| ***A63B 21/068*** | (2006.01) |
| ***A63B 71/00*** | (2006.01) |
| ***A63B 71/06*** | (2006.01) |
| *A63B 23/04* | (2006.01) |
| *A63B 21/04* | (2006.01) |
| *A63B 22/20* | (2006.01) |

(52) U.S. Cl.

CPC ..... *A63B 22/0087* (2013.01); *A63B 22/20* (2013.01); *A63B 23/0211* (2013.01); *A63B 23/0216* (2013.01); *A63B 23/0233* (2013.01); *A63B 23/03525* (2013.01); *A63B 23/0405* (2013.01); *A63B 23/1209* (2013.01); *A63B 2208/0219* (2013.01); *A63B 2208/0247* (2013.01); *A63B 2208/0252* (2013.01); *A63B 2208/0295* (2013.01); *A63B 2220/30* (2013.01); *A63B 2225/68* (2013.01); *A63B 2225/682* (2013.01); *A63B 2230/045* (2013.01)

(56) References Cited

U.S. PATENT DOCUMENTS

| | | | |
|---|---|---|---|
| 4,759,540 | A | 7/1988 | Yu |
| 4,798,378 | A | 1/1989 | Jones |
| 4,974,620 | A | 12/1990 | Quillan |
| 5,066,005 | A | 11/1991 | Luecke |
| 5,263,913 | A | 11/1993 | Boren |
| D362,700 | S | 9/1995 | Breibart |
| D382,319 | S | 8/1997 | Gerschefske |
| 5,681,249 | A | 10/1997 | Endelman |
| 5,803,328 | A | 9/1998 | Nakahara |
| 5,885,197 | A | 3/1999 | Barton |
| 5,967,955 | A | 10/1999 | Westfall |
| 6,179,753 | B1 | 1/2001 | Barker |
| 7,163,500 | B2 | 1/2007 | Endelman |
| 7,614,988 | B1 | 11/2009 | Kiser |
| 7,803,095 | B1 | 9/2010 | Lagree |
| 7,931,570 | B2 | 4/2011 | Hoffman |
| 8,734,302 | B2 | 5/2014 | Hsieh |
| 2001/0056011 | A1 | 12/2001 | Endelman |
| 2003/0119635 | A1 | 6/2003 | Arbuckle |
| 2003/0197026 | A1 | 10/2003 | Ashe |
| 2004/0217140 | A1 | 11/2004 | Zola |
| 2005/0164856 | A1 | 7/2005 | Parmater |
| 2006/0046914 | A1 | 3/2006 | Endelman |
| 2006/0199712 | A1 | 9/2006 | Barnard |
| 2008/0070765 | A1 | 3/2008 | Brown |
| 2008/0248935 | A1 | 10/2008 | Solow |
| 2009/0014459 | A1 | 1/2009 | Hood |
| 2010/0089935 | A1 | 4/2010 | Heilman |
| 2010/0227748 | A1 | 9/2010 | Campanaro |
| 2010/0308072 | A1 | 12/2010 | Hood |
| 2011/0143898 | A1 | 6/2011 | Trees |
| 2011/0166002 | A1 | 7/2011 | Savsek |
| 2011/0172069 | A1 | 7/2011 | Gerschefske |
| 2012/0241333 | A1 | 9/2012 | Mueller |
| 2012/0283079 | A1 | 11/2012 | Solow |
| 2012/0295771 | A1 | 11/2012 | Lagree |
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2015/0024914 | A1 | 1/2015 | Lagree |
| 2015/0057127 | A1 | 2/2015 | Lagree |
| 2015/0065318 | A1 | 3/2015 | Lagree |
| 2015/0072841 | A1 | 3/2015 | Lagree |
| 2015/0136623 | A1 | 5/2015 | Gooden |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0349327 | A1 | 12/2017 | Cwojdzinski |
| 2018/0184858 | A1 | 7/2018 | Kasten |

EXERCISE MACHINE ACCESSORY SYSTEM

CROSS REFERENCE TO RELATED APPLICATIONS

The present application is a continuation of U.S. application Ser. No. 15/792,336 filed on Oct. 24, 2017 which issues as U.S. Pat. No. 10,751,600 on Aug. 25, 2020, which claims priority to U.S. Provisional Application No. 62/412,369 filed Oct. 25, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine accessory system for facilitating exerciser rehydration during a workout and antibacterial machine wipe down.

Related Art

Any discussion of the related art throughout the specification should in no way be considered as an admission that such related art is widely known or forms part of common general knowledge in the field.

Exercise machines have been in use for many years. Stationary bicycles and treadmills are recognized examples of exercise machines that are used throughout a workout session. On these machines, water bottle holders similar to bicycle water bottle holders are sometimes installed by the gym or manufacturers as a convenience accessory for the exercisers.

Another common exercise machine that has enjoyed increasing popularity is the reformer machine used to perform conventional Pilates exercises. A conventional reformer machine generally includes a frame, a track extending across the frame, and a carriage slidably connected to the track. The carriage is connected to one end of the frame by one or more bias members such as springs. U.S. Pat. No. 7,163,500 to Endelman discloses a conventional reformer machine suitable for use in performing conventional Pilates exercises.

Recent developments with reformer machines have increased the number and variety of exercises performable on the reformer machines. U.S. Pat. No. 8,641,585 to Sebastien Lagree discloses an exercise machine that improves upon conventional reformer machines.

SUMMARY

An example embodiment is directed to an exercise machine accessory system. The exercise machine accessory system includes an exercise machine having a first end and a second end, first and second stationary exercise platforms, a movable carriage movably positioned upon a rail, a biasing member connected to the movable carriage, first and second handle assemblies connected to the frame of the exercise machine, a first bottle holder, a first antibacterial wipes dispenser and/or a first disposal receptacle connected to the first right handle assembly or the first left handle assembly.

There has thus been outlined, rather broadly, some of the embodiments of the exercise machine accessory system in order that the detailed description thereof may be better understood, and in order that the present contribution to the art may be better appreciated. There are additional embodiments of the exercise machine accessory system that will be described hereinafter and that will form the subject matter of the claims appended hereto. In this respect, before explaining at least one embodiment of the exercise machine accessory system in detail, it is to be understood that the exercise machine accessory system is not limited in its application to the details of construction or to the arrangements of the components set forth in the following description or illustrated in the drawings. The exercise machine accessory system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

The various figures illustrate one or more embodiments that include an exercise machine having a first end and a second end, first and second stationary exercise platforms, a movable carriage movably positioned upon a rail, a biasing member connected to the movable carriage, first and second handle assemblies connected to the frame of the exercise machine, a first bottle holder, a first antibacterial wipes dispenser and/or a first disposal receptacle connected to the first right handle assembly or the first left handle assembly.

Figure 1:
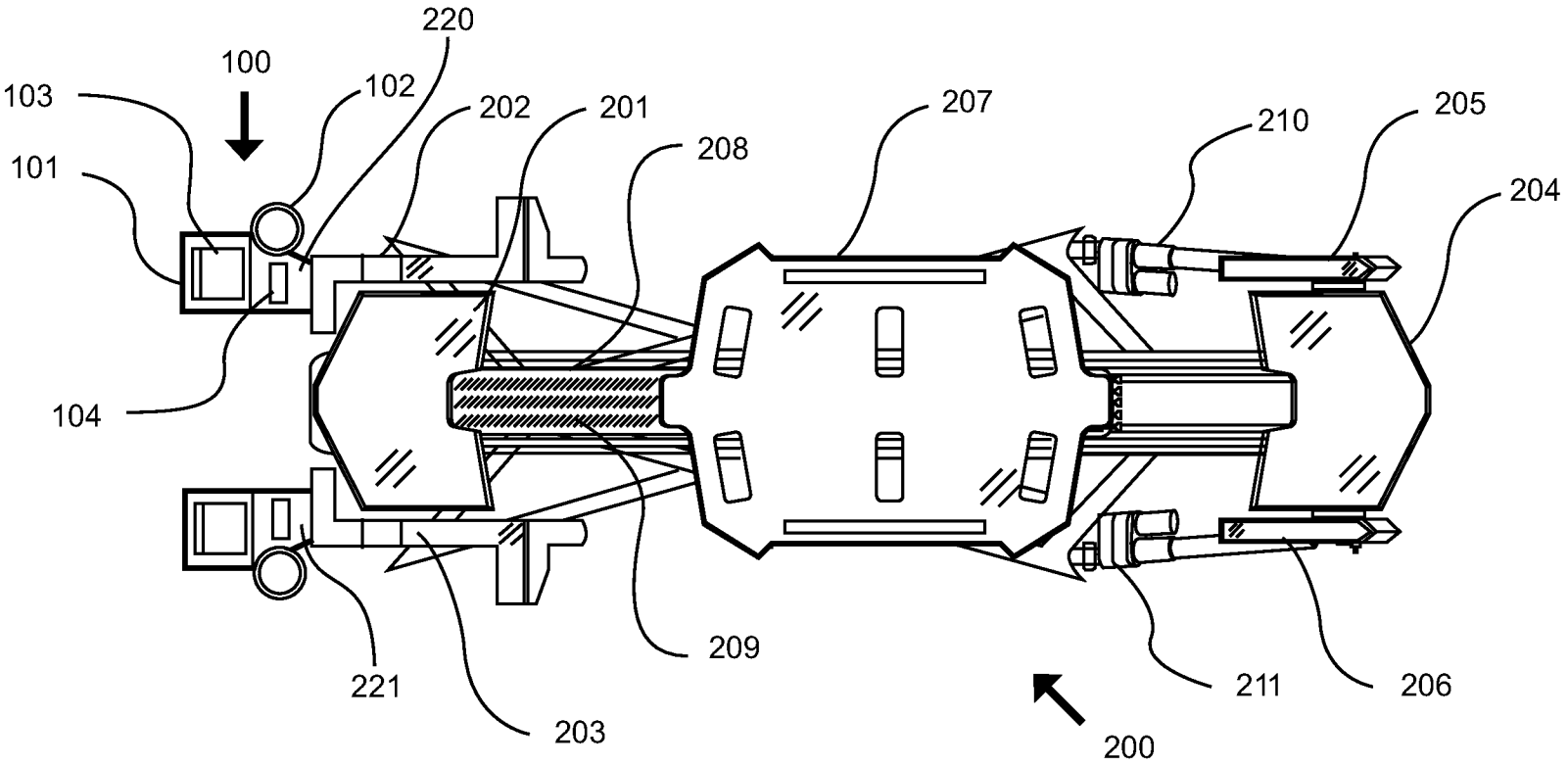
FIG. 1 is a top view of an exercise machine accessory system in accordance with an example embodiment.

FIG. 1 is an exemplary diagram showing a top view of an exercise machine accessory system in accordance with an example embodiment. The exercise machine 200 preferably comprises an elongated frame, a first stationary exercise platform 201, a front right and left handle assembly 202, 203, a second stationary exercise platform 204, a back right and left handle assembly 205, 206, a platform 207 or carriage 207 movable along one or more rails substantially between the front and back stationary exercise platforms 201, 204, a longitudinal support structure and rails 208, and one or more biasing members 209 (e.g. springs, elastic bands, electromagnetic brakes) removably attached between the longitudinal structure proximal to the front stationary platform and the movable platform. The biasing members 209 apply a resistance against which an exerciser must overcome to move the movable platform 207 towards the stationary back platform during exercise. U.S. Pat. No. 8,641,585 to Sebastien Lagree discloses an exemplary exercise machine and is incorporated herein.

A right linear actuator 210 and a left linear actuator 211 provide for the lifting or lowering of the back end of the machine, and further provide for the rotation of the machine clockwise or counterclockwise about the longitudinal axis of the longitudinal rail structure, the tilting and rotation of the machine exercise platforms thereby providing for an enhanced exercise experience.

Those skilled in the art will appreciate that, during exercise, an exerciser will often prefer to monitor their physiological performance by means of heart rate or exercising speed, as just two examples of metrics that may be monitored, and may require rehydration during the exercise period. The exercise machine of the present invention therefore provides for a novel accessory for displaying exercise information, and for storing a beverage container.

A first accessory assembly 100 is shown affixed to the right front handle assembly 202 by means of an accessory structure 101. The assembly may comprise one or more of a water bottle holder 102, a display screen 103 used by the exerciser to view certain information related to their exercising session, and a dispenser 104 used to dispense antimicrobial wipes.

The display screen just described may display, for instance, the exerciser's heart rate, the remaining exercise session time, instructions for performing an exercise, exercise repetition speed, or machine resistance level. The display screen may be interactive, providing for an exerciser to select certain machine settings or to request the display of certain information. The examples just described are not meant to be limiting, and any information or interactive controls preferred by an exerciser or exercise instructor may be shown on the display screen.

Further, the display screen 103 may be a wireless device, such as a smartphone or tabled computer detachable from the accessory structure 101. The attachment means not shown may comprise a hook and loop fastening system, integral slots or clips integral with the accessory structure into which a detachable device may be slid or clipped in, or other means of securing a detachable wireless device to a support structure as would be well known to shoes skilled in the art. The means of attaching a removable wireless device to a support structure are not meant to be limiting.

It should be noted that for brevity the foregoing description will not be repeated for a second accessory assembly, however, a second accessory assembly may be affixed to the left front handle assembly, the second accessory assembly comprising one or more of the features of the first accessory assembly just described.

Figure 2:
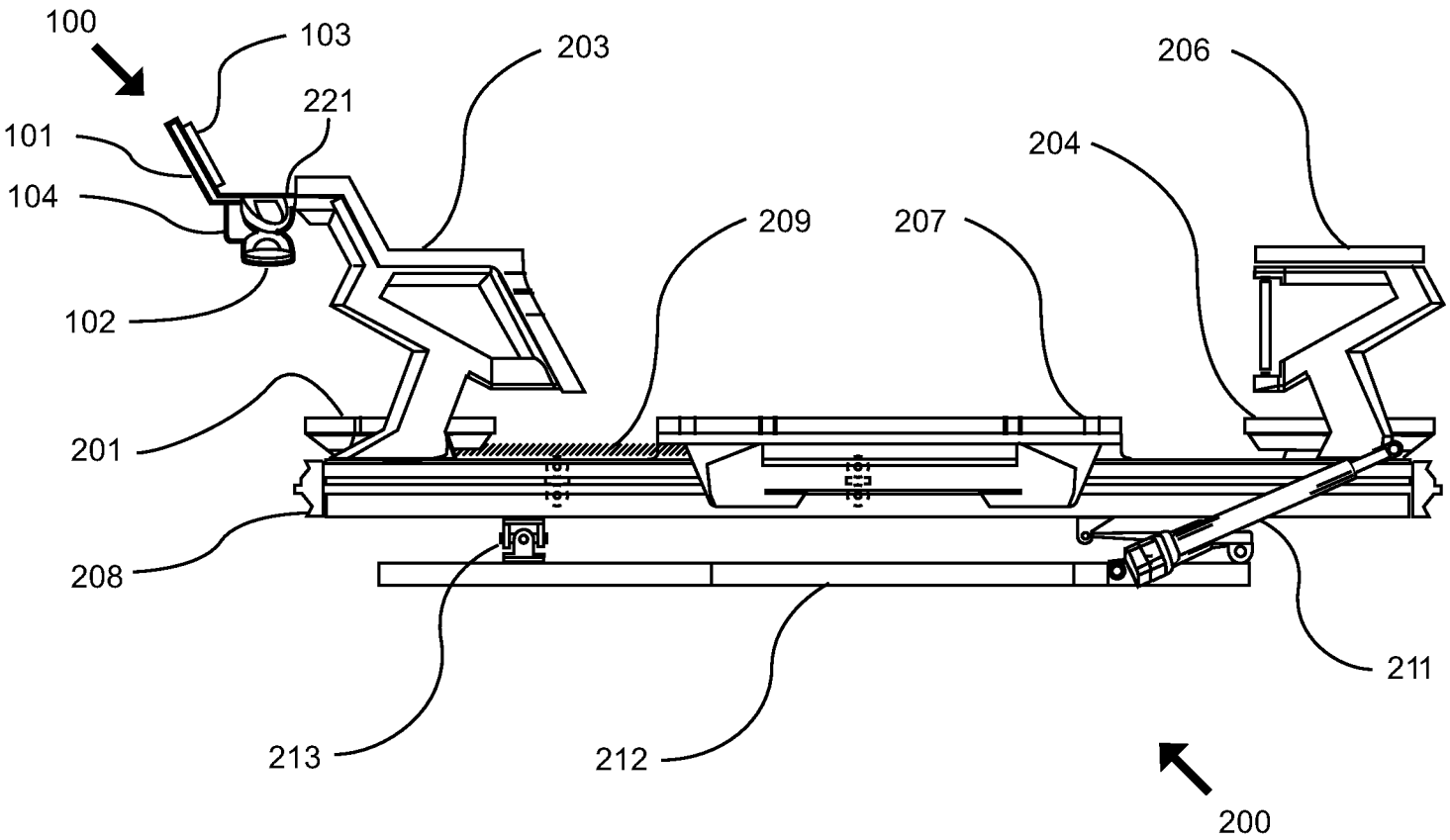
FIG. 2 is a side view of an exercise machine accessory system in accordance with an example embodiment.

FIG. 2 is an exemplary diagram showing a side view of an exercise machine accessory system in accordance with an example embodiment. An exercise machine 200 comprises a first stationary exercise platform 201, a left handle assembly 203 providing for multiple gripping, pushing and pulling surfaces, a second stationary exercise platform 204, a back left handle assembly 206 providing for multiple gripping, pushing and pulling surfaces, a platform 207 movable along one or more rails substantially between the front and back stationary exercise platforms 201, 204, a longitudinal support structure and rails 208, and one or more biasing members 209 removably attached between the longitudinal structure proximal to the front stationary platform and the movable platform.

The machine just described is supported by a structural base 212 right linear actuator, an articulating support member 213 such as a universal joint, and left linear actuator 211 and a right linear actuator not shown, but which provide for the lifting or lowering of the back end of the machine, and further provide for the rotation of the machine clockwise or counterclockwise about the longitudinal axis of the longitudinal rail structure.

Figure 5B:
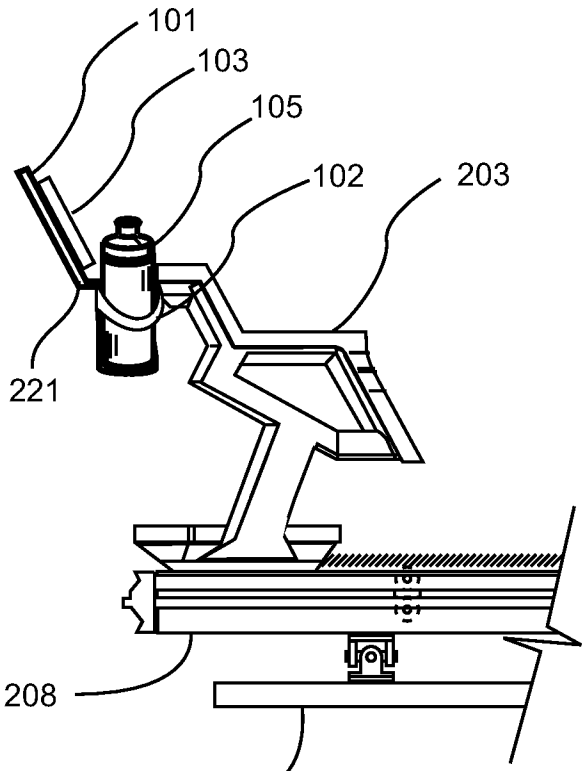
FIG. 5B is a side view of the front portion of an exercise machine accessory system in accordance with an example embodiment.

An accessory assembly 100 is shown affixed to the left front handle assembly 203 by means of an accessory structure 101. The assembly comprises one or more of a water bottle holder 102, a display screen 103 or attachment means for a detachable interactive display device, and a dispenser 104 used to store and dispense antimicrobial wipes. As shown in FIGS. 1, 7A, 7B, 8, 9, and 11A, an accessory assembly structure 101 having a surface 220, 221 is affixed to a surface of one of the handle assemblies 202, 203, 205, 206. As shown in FIGS. 1 through 9, the accessory assembly structure 101 extends outwardly from an exterior side 222 of the corresponding handle assembly 202, 203, 205, 206. As shown in FIGS. 1 through 9, a water bottle holder 102 is connected to the accessory assembly structure 101. As shown in FIGS. 1, 2, 4A, 6A, 6B, 7A, 7B, 8, 9, 11A and 11B, a wipes dispenser 104 and/or disposal receptacle 111 are connected to the accessory assembly structure 101. As shown in FIG. 7B, the accessory assembly structure 101 may be movable relative to the handle assembly 202 as depicted by the double pointed arrow.

Figure 3B:
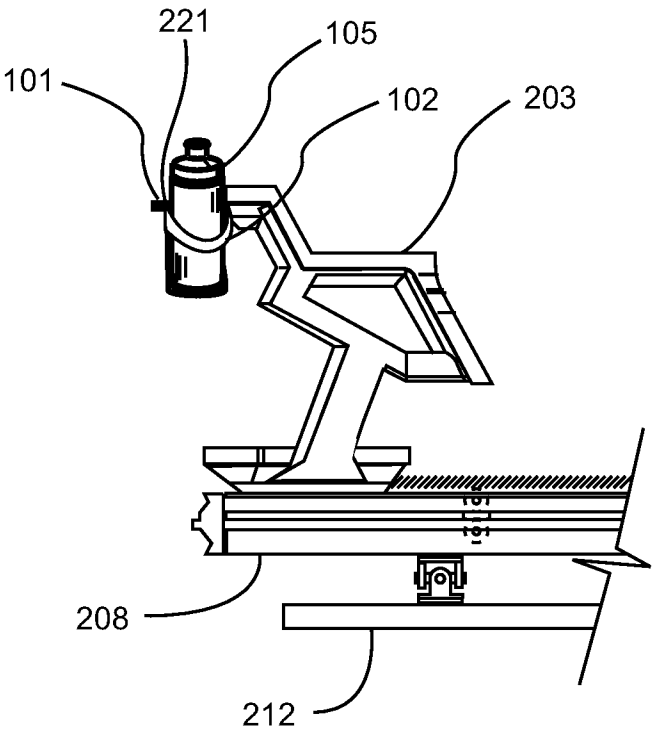
FIG. 3B is a side view of the front portion an exercise machine accessory system in accordance with an example embodiment.
Figure 3A:
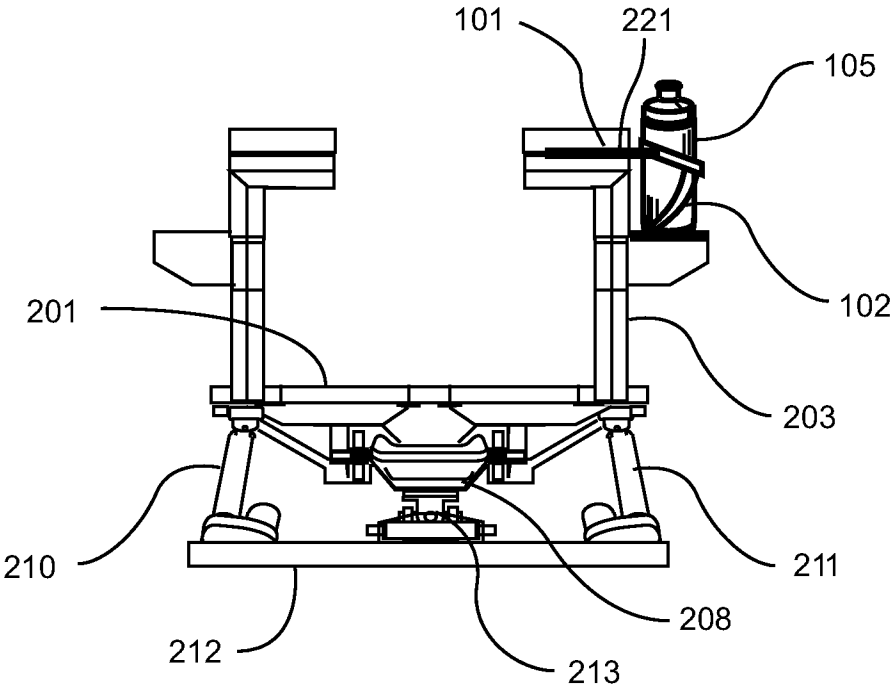
FIG. 3A is a front view of an exercise machine accessory system in accordance with an example embodiment.

FIG. 3A is an exemplary diagram showing a front view of an exercise machine accessory system in accordance with an example embodiment. More specifically, an exercise machine base 213 supports a longitudinal rail structure 208 of an exercise machine by means of an articulating support member 213 and a left and right actuator 211, 210. A front stationary platform 201 and a front left handle assembly 203 are affixed to the longitudinal rail structure by one or more structural members not shown.

An accessory assembly structure 101 is affixed to the front left handle assembly providing for the attachment of a water bottle holder 102 used by the exerciser for storing a water bottle 105. It should be noted that a mirror image of the accessory structure, water bottle holder and water bottle just described may be affixed to one or more front or back handle assemblies of the exercise machine.

FIG. 3B is an exemplary diagram showing a side view of the front portion of an exercise machine accessory system in accordance with an example embodiment. A base structure 212 is shown supporting a longitudinal rail structure 208 and a front left handle assembly 203. An accessory assembly structure 101 is affixed to the front left handle assembly providing for the attachment of a water bottle holder 102 used by the exerciser for storing a water bottle 105.

Figure 4B:
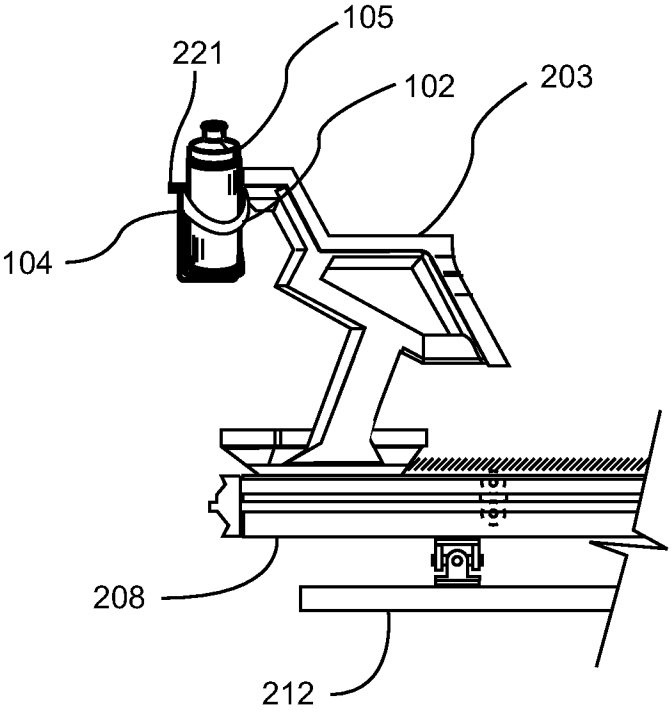
FIG. 4B is a side view of the front portion of an exercise machine accessory system in accordance with an example embodiment.
Figure 4A:
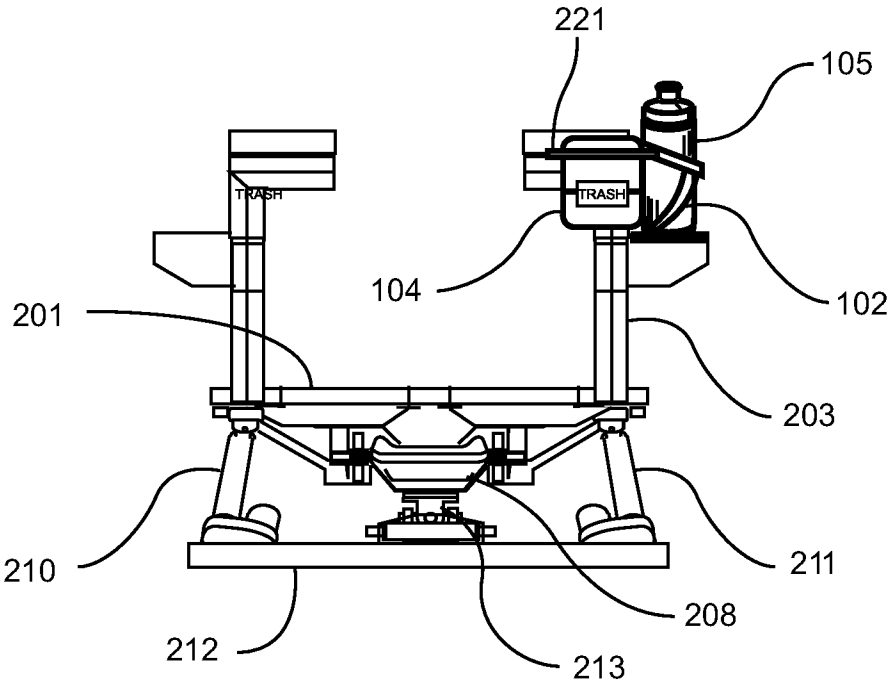
FIG. 4A is a front view of an exercise machine accessory system in accordance with an example embodiment.

FIG. 4A is an exemplary diagram showing a front view of an exercise machine with a variation of an exercise machine accessory system in accordance with an example embodiment. More specifically, an exercise machine base 213 supports a longitudinal rail structure 208 of an exercise machine by means of an articulating support member 213 and a left and right actuator 211, 210. A front stationary platform 201 and a front left handle assembly 203 are affixed to the longitudinal rail structure by one or more structural members not shown.

An accessory assembly structure 101 is affixed to the front left handle assembly providing for the attachment of a water bottle holder 102 used by the exerciser for storing a water bottle 105, and a wipes assembly 104 providing for the storage, dispensing and disposal of antibacterial wipes. It should be noted that a mirror image of the accessory structure, water bottle holder, water bottle and the antibacterial wipes assembly just described may be affixed to one or more front or back handle assemblies of the exercise machine.

FIG. 4B is an exemplary diagram showing a side view of the front portion of an exercise machine with a variation of an exercise machine accessory system in accordance with an example embodiment. A base structure 212 is shown supporting a longitudinal rail structure 208 and a front left handle assembly 203. An accessory assembly structure 101 is affixed to the front left handle assembly providing for the attachment of a water bottle holder 102 used by the exerciser for storing a water bottle 105, and a wipes assembly 104 providing for the storage, dispensing and disposal of antibacterial wipes.

Figure 5A:
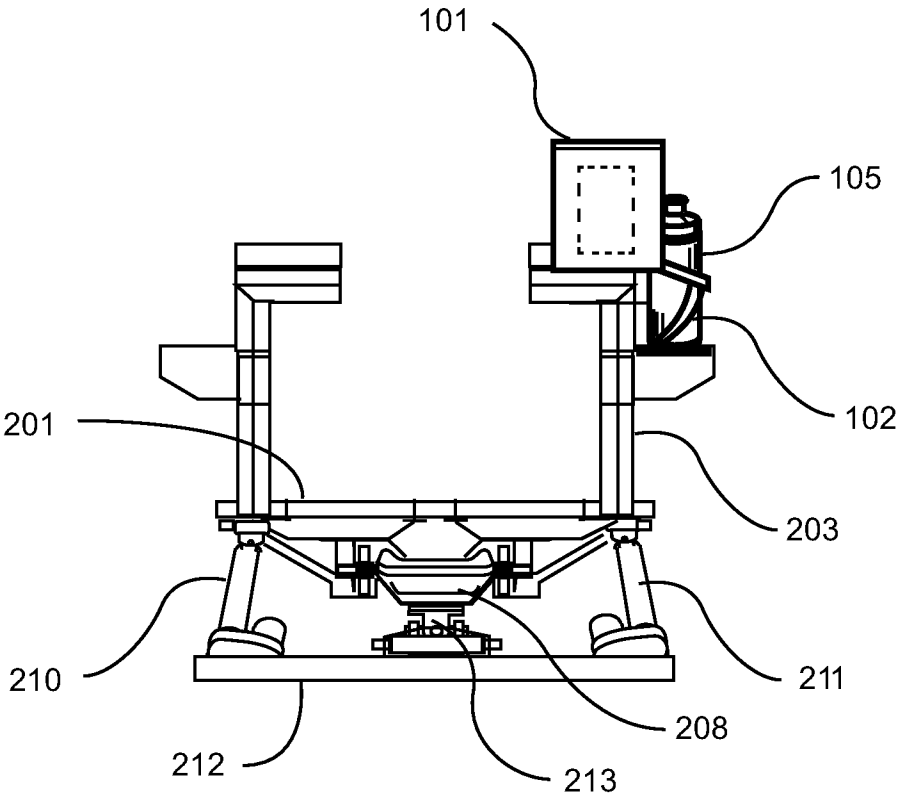
FIG. 5A is a front view of an exercise machine accessory system in accordance with an example embodiment.
Figure 6B:
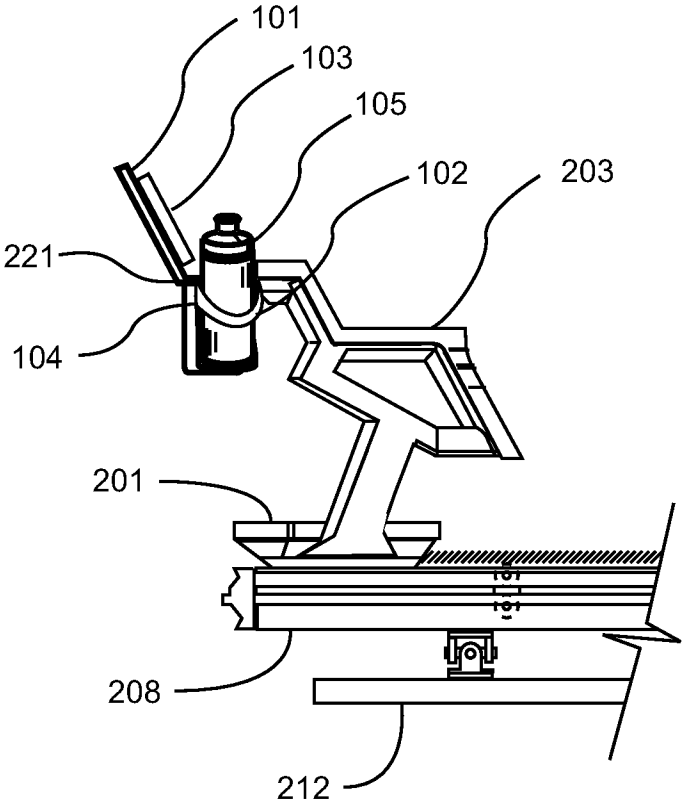
FIG. 6B is a side view of the front portion of an exercise machine accessory system in accordance with an example embodiment.

FIG. 5A is an exemplary diagram showing a front view of an exercise machine with a variation of an exercise machine accessory system in accordance with an example embodiment. More specifically, an exercise machine base 213 supports a longitudinal rail structure 208 of an exercise machine by means of an articulating support member 213 and a left and right actuator 211, 210. A front stationary platform 201 and a front left handle assembly 203 are affixed to the longitudinal rail structure by one or more structural members not shown.

An accessory assembly structure 101 is affixed to the front left handle assembly providing for the attachment of a display screen not shown, but indicated by the dashed line indicating the approximate location of the display screen on the distal side of the assembly structure, and a water bottle holder 102 used by the exerciser for storing a water bottle 105. It should be noted that a mirror image of the accessory structure, water bottle holder, water bottle and the display screen just described may be affixed to one or more front or back handle assemblies of the exercise machine.

FIG. 5B is an exemplary diagram showing a side view of the front portion of an exercise machine with a variation of an exercise machine accessory system in accordance with an example embodiment. A base structure 212 is shown supporting a longitudinal rail structure 208 and a front left handle assembly 203. An accessory assembly structure 101 is affixed to the front left handle assembly providing for the attachment of a display screen 103, and a water bottle holder 102 used by the exerciser for storing a water bottle 105.

Figure 6A:
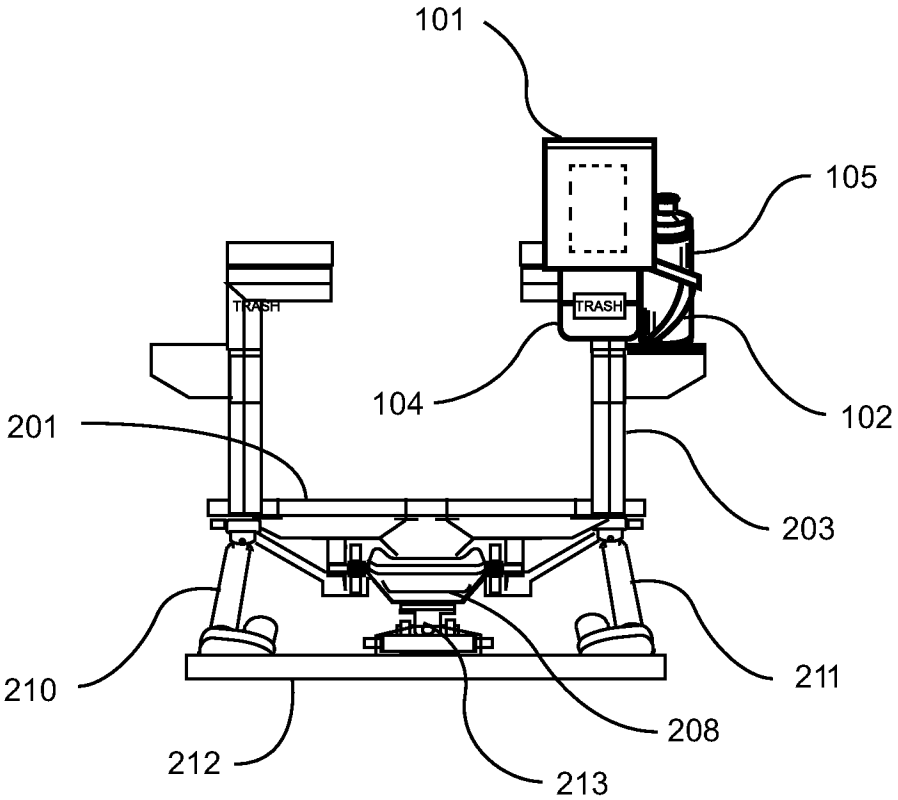
FIG. 6A is a front view of an exercise machine accessory system in accordance with an example embodiment.

FIG. 6A is an exemplary diagram showing a front view of an exercise machine with yet a variation of an exercise machine accessory system in accordance with an example embodiment. More specifically, an exercise machine base 213 supports a longitudinal rail structure 208 of an exercise machine by means of an articulating support member 213 and a left and right actuator 211, 210. A front stationary platform 201 and a front left handle assembly 203 are affixed to the longitudinal rail structure by one or more structural members not shown.

An accessory assembly structure 101 is affixed to the front left handle assembly providing for the attachment of a display screen not shown, but indicated by the dashed line indicating the approximate location of the display screen on the distal side of the assembly structure, a water bottle holder 102 used by the exerciser for storing a water bottle 105, and a wipes assembly 104 providing for the storage, dispensing and disposal of antibacterial wipes.

FIG. 6B is an exemplary diagram showing a side view of the front portion of an exercise machine with yet a variation of an exercise machine accessory system in accordance with an example embodiment. A base structure 212 is shown supporting a longitudinal rail structure 208 and a front left handle assembly 203. An accessory assembly structure 101 is affixed to the front left handle assembly providing for the attachment of a display screen 103, a water bottle holder 102 used by the exerciser for storing a water bottle 105, and a wipes assembly 104 providing for the storage, dispensing and disposal of antibacterial wipes.

Figure 7A:
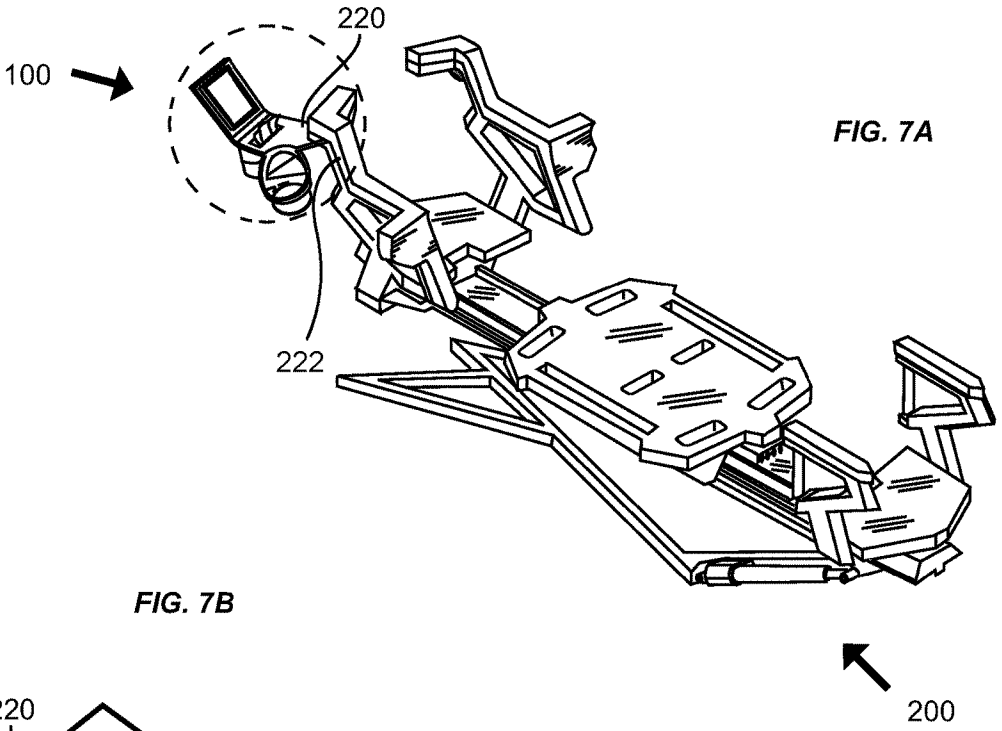
FIG. 7A is a perspective view of an exercise machine accessory system in accordance with an example embodiment.
Figure 7B:
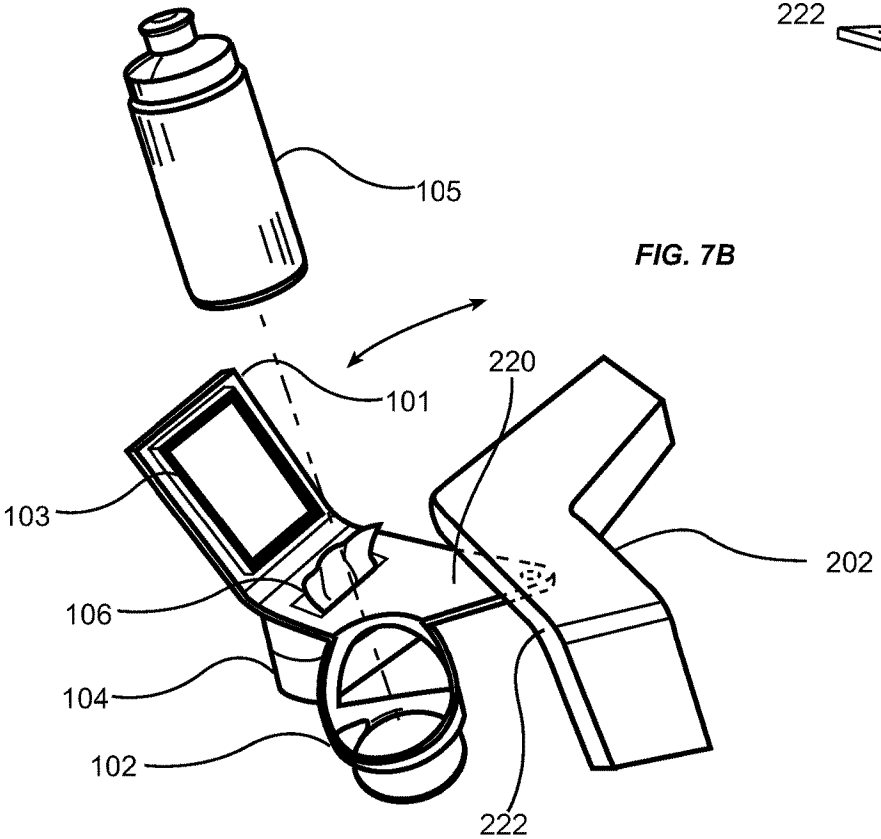
FIG. 7B is a magnified perspective view of an exercise machine accessory system in accordance with an example embodiment.

FIG. 7A is an exemplary diagram showing a perspective view of an exercise machine accessory system in accordance with an example embodiment. An exercise machine 200 as previously described is shown comprising one variation of an attached accessory assembly 100 in one of a plurality of possible locations.

FIG. 7B is an exemplary diagram showing a close up view of a portion of an exercise machine accessory system in accordance with an example embodiment. More specifically, a portion of a front left handle assembly 202 is shown with an accessory assembly structure 101 affixed to the underside of the handle. The accessory structure may be affixed to the handle by any number of well-known means including for example mechanical fasteners, adhesives, hook and loop material, and may be affixed in a permanent position, or rotatably affixed to allow for repositioning by an exerciser as indicated by the double headed arrow.

In the configuration shown, the accessory structure provides for the attachment of a display screen 103, or optionally the removable attachment of an interactive display device as previously described, a water bottle holder 102 used by an exerciser for the storage of a water bottle 105, and a wipes assembly 104 providing for easy accessibility by an exerciser to antibacterial wipes 106.

Figure 8:
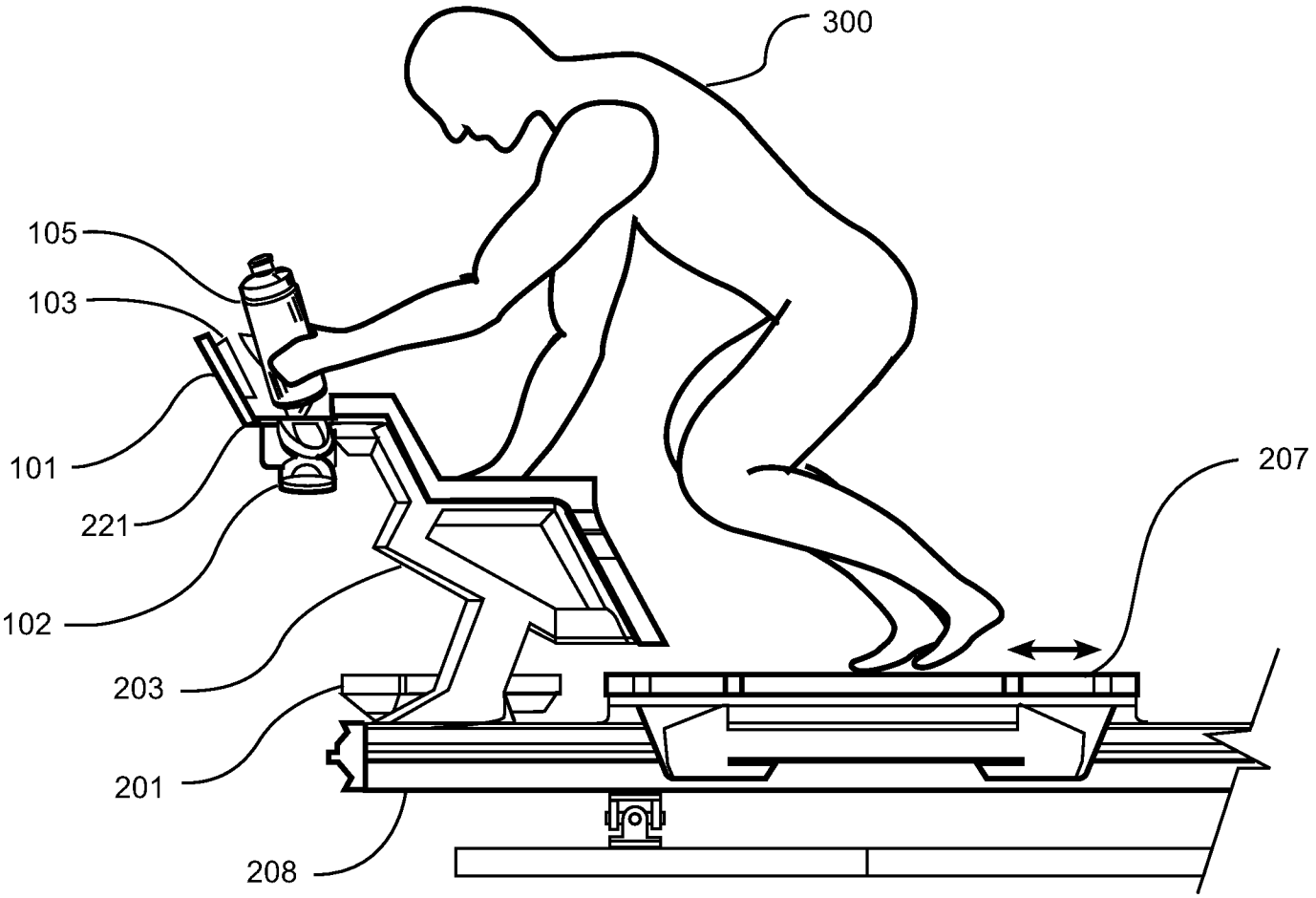
FIG. 8 is a side view of an exercise machine accessory system with an exerciser in accordance with an example embodiment.

FIG. 8 is an exemplary diagram showing a side view of a substantially front portion of an exercise machine with an exerciser. An exerciser 300 is positioned upon an exercise machine facing the frond stationary platform 201 with the feet placed upon the movable carriage 207, and supporting the upper body by gripping one or more of the right handle or left front handle structure 203. In practice, the exerciser would prefer to not break from the class tempo and disrupt the exercise routine by stopping to take a drink. Therefore, an embodiment of the present invention provides a water bottle holder 102 integral with an accessory structure affixed to a front handle structure 101 providing for the storage and easy access by the exerciser to their water bottle 105. Further, the drawing shows a display screen 103 positioned so that an exerciser can readily view the information that may be presented on the screen.

Figure 9:
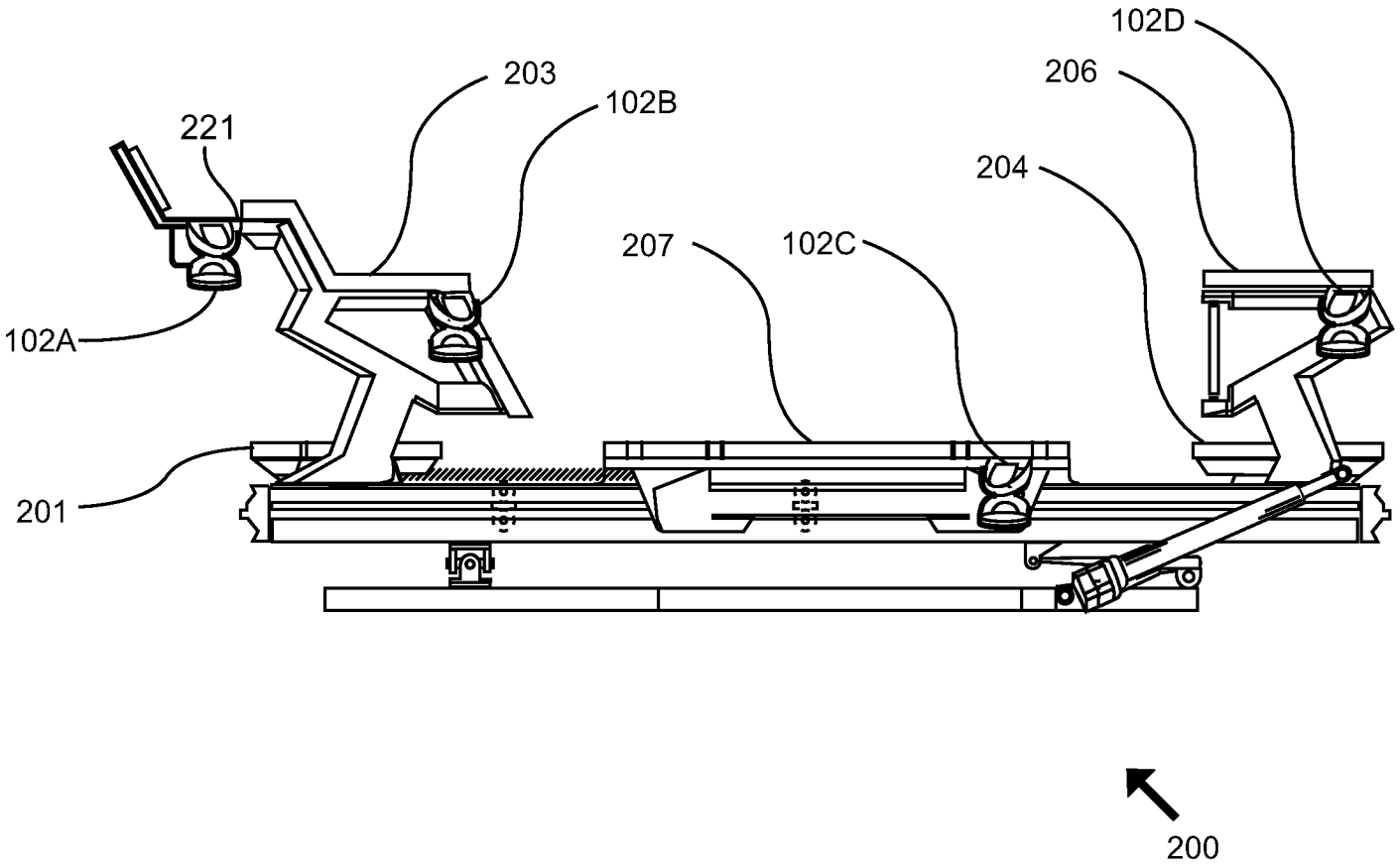
FIG. 9 is a side view of an exercise machine accessory system with optional locations for the accessories in accordance with an example embodiment.

FIG. 9 is an exemplary diagram showing a side view of an exercise machine 200 with optional locations of new and novel accessories. The positioning of the accessory as previously described is not meant to be limiting, and placement of the water bottle holder may be convenient for the exerciser when placed in any one of a plurality of locations on the machine. More specifically, a water bottle holder 102A is positioned on an accessory affixed to the front left handle structure as previously described. Optionally, the water bottle holder 102B may be positioned in an alternate location on the front left handle structure. It should be noted that descriptions of water bottle locations on the left side of the machine may apply equally to the right side of the exercise machine without limitation (along with front or back of the exercise machine)

Another possible location for a water bottle holder 102D may be the left back handle structure. Yet another location for a water bottle holder 102C is affixed to the movable carriage so that an exerciser on the movable carriage has access to the water bottle regardless of the position of the carriage between the front and rear exercise platforms 201, 204.

As can be readily appreciated by those skilled in the art, water bottle holders are a new and novel accessory for exercise machines with movable carriages, and there are many exerciser positions assumed throughout an exercise routine that preferably identify a plurality of preferred locations for affixing a water bottle holder to the machine.

Figure 10B:
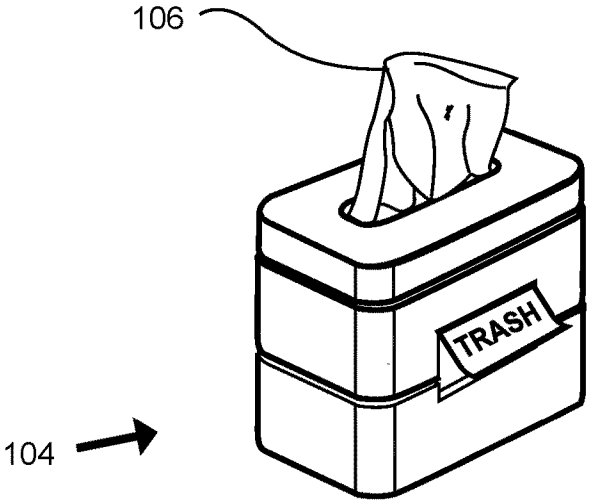
FIG. 10B is a perspective view of an exercise machine accessory system in accordance with an example embodiment.
Figure 10A:
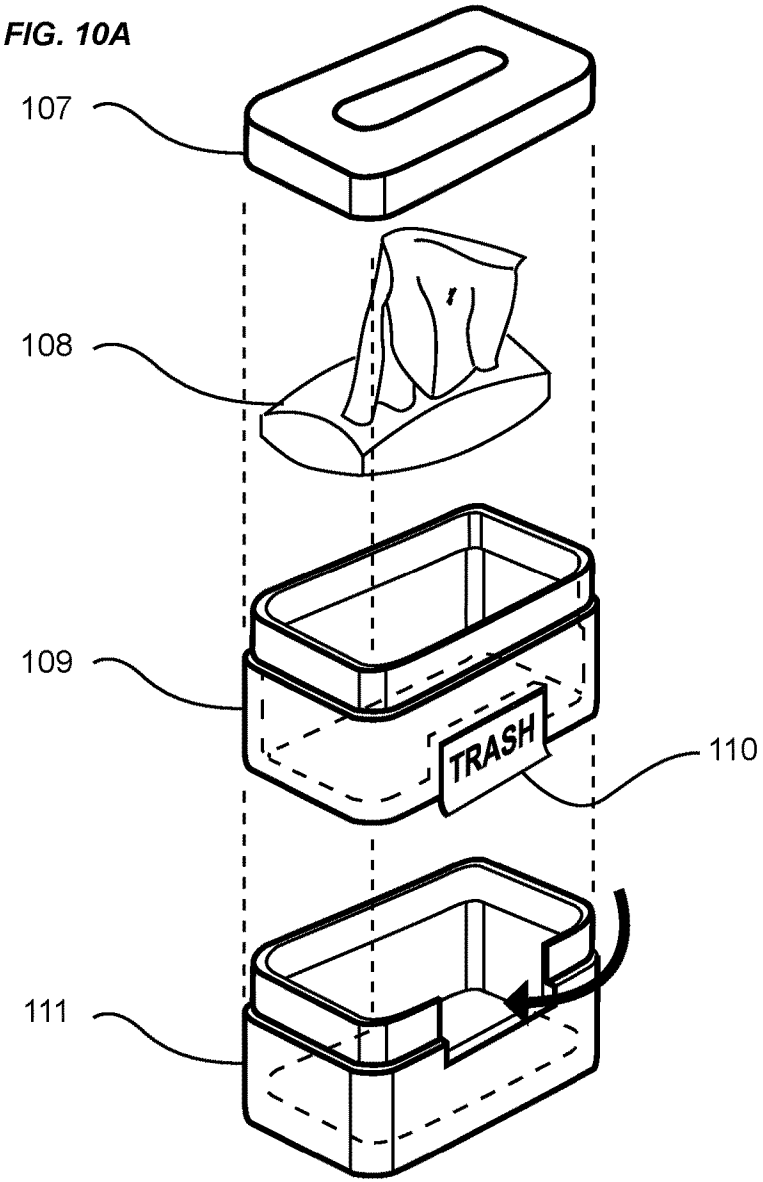
FIG. 10A is an exploded perspective view of an exercise machine accessory system in accordance with an example embodiment.

FIG. 10A is an exemplary diagram showing an exploded perspective view of an exercise machine accessory. More specifically, a multi-compartment container to store antibacterial wipes for a machine, dispense the wipes and receive used wipes is shown. The new and novel accessory for an exercise machine therefore provides the immediate access to wipes for washing down a machine after use, and a disposal receptacle that obviates the need for an exerciser to walk across the facility to dispose of used wipes.

In the drawing, a dispenser 107 cover is removably attachable to a wipes storage 109 compartment. Antibacterial wipes 108, which may be packaged in a dispensing package such as cellophane, or not packaged by provided with features that allow pulling one wipe from a dispenser to feed a subsequent wipe into the dispenser, is shown. A package of wipes, or a plurality of unpackaged wipes therefore is stored in the wipes storage compartment for dispensing.

A disposal receptacle 111 is removably attachable to the wipes storage 109, providing a dispensing location for used wipes. A disposal door 110 conceals disposed wipes until the gym staff empties the wipes receptacle.

The illustration shown is not meant to be limiting, and those skilled in the art will appreciate that the wipes dispenser may be a pull-up configuration through a substantially horizontal cover as shown, a pull-down configuration through a substantially horizontal plane positioned at the lower side of the dispenser, or a pull-out configuration through a substantially vertical plane such as the front facing surface of the dispenser. Further, those skilled in the art will appreciate that the dispenser and disposal receptacle may be configured substantially as shown, or the disposal receptacle may be positioned above or beside the wipes storage.

FIG. 10B is an exemplary diagram showing a perspective view of an assembled exercise machine accessory. As can be readily seen, the assembly 104 of the wipes dispenser and disposal receptacle represents an efficiently compact accessory attachable to an exercise machine by a variety of attachment means not shown, providing for convenient access to dispensed antibacterial wipes 106 for cleaning a machine after exercising.

Figure 11B:
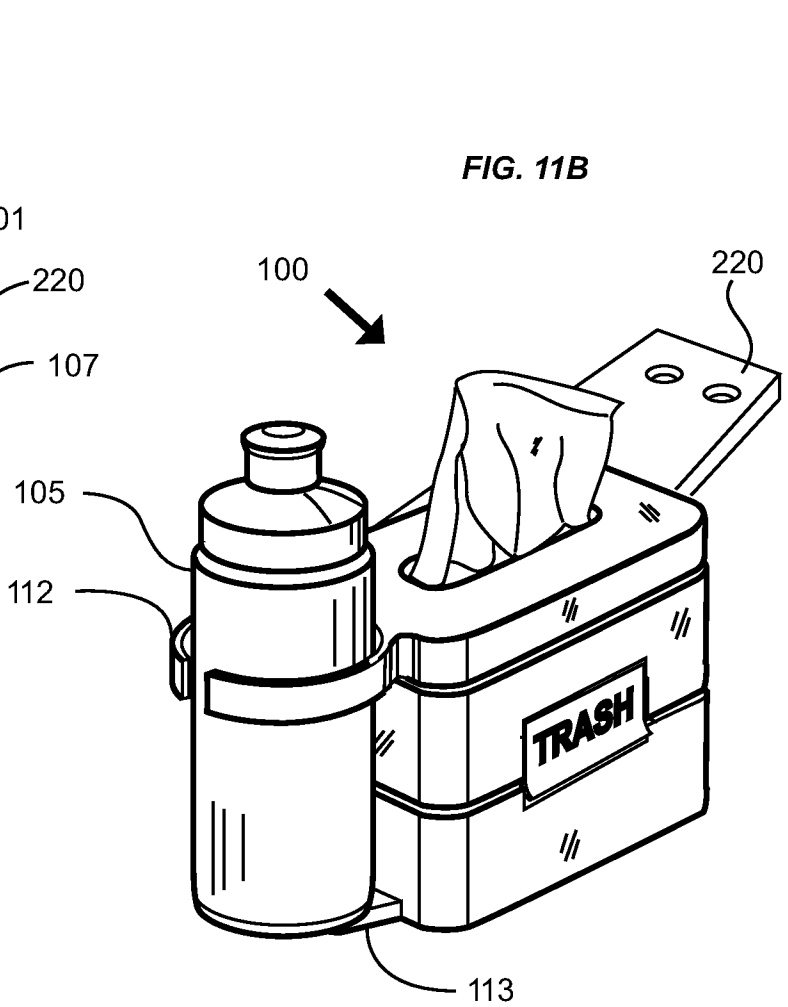
FIG. 11B is a perspective view of a water bottle retained by the exercise machine accessory in accordance with an example embodiment.
Figure 11A:
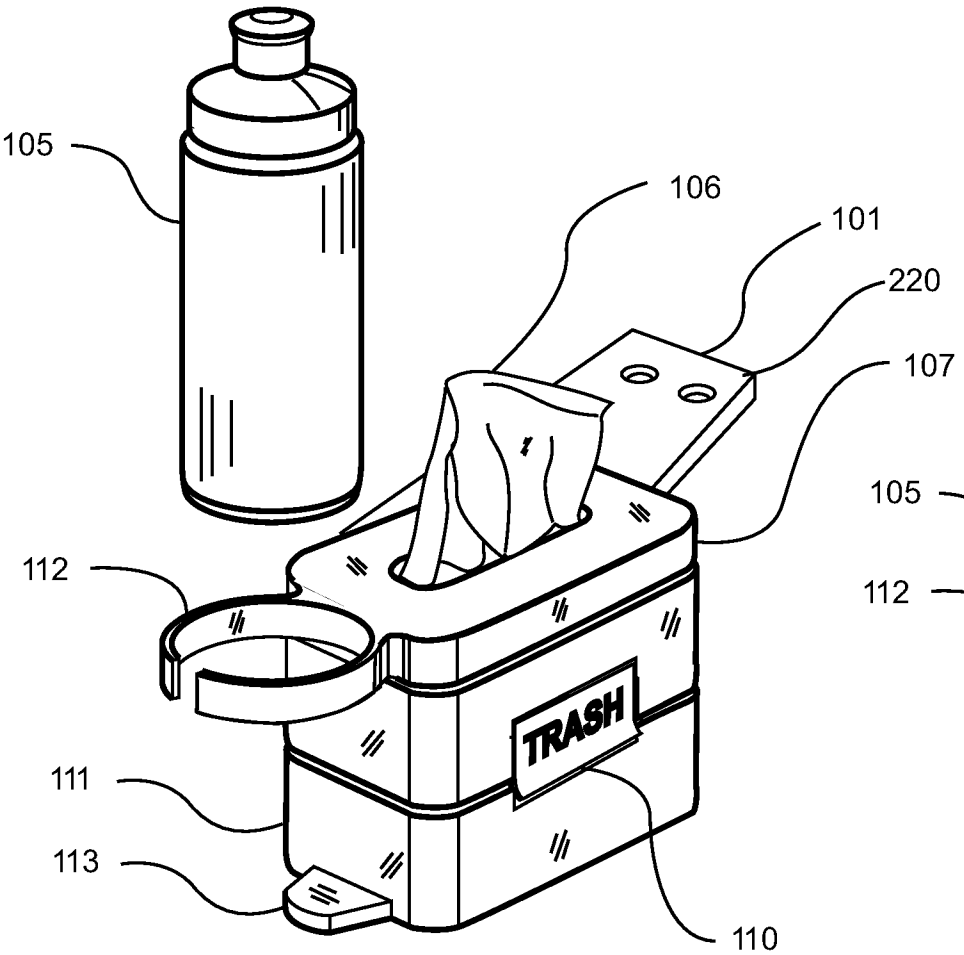
FIG. 11A is a perspective view of a water bottle withdrawn from an exercise machine accessory in accordance with an example embodiment.

FIG. 11A is an exemplary diagram showing a perspective view of water bottle 105 withdrawn from an exercise machine accessory. More specifically, an accessory assemble comprises an accessory structure 101 providing for the attachment of the assembly to an exercise machine, and the accessory providing for dispensing antibacterial wipes 106, and a disposal door 100 to access the disposal receptacle for disposing of used wipes. Further, the wipes dispenser 107 provides for an upper water bottle retainer 112, and the disposal receptacle 111 provides for a lower water bottle support member 113, together the upper retainer and lower bottle support member together comprising a water bottle holder.

FIG. 11B is an exemplary diagram showing a perspective view of water bottle retained by an exercise machine accessory. In practice, an accessory assembly 100 is affixed to an exercise machine by various means including mechanical fasteners, adhesives or any number of other well-known means, the accessory providing for a retainer 112 and support member 113 for holding a water bottle 105, and a wipes dispenser and disposal.

Figure 12:
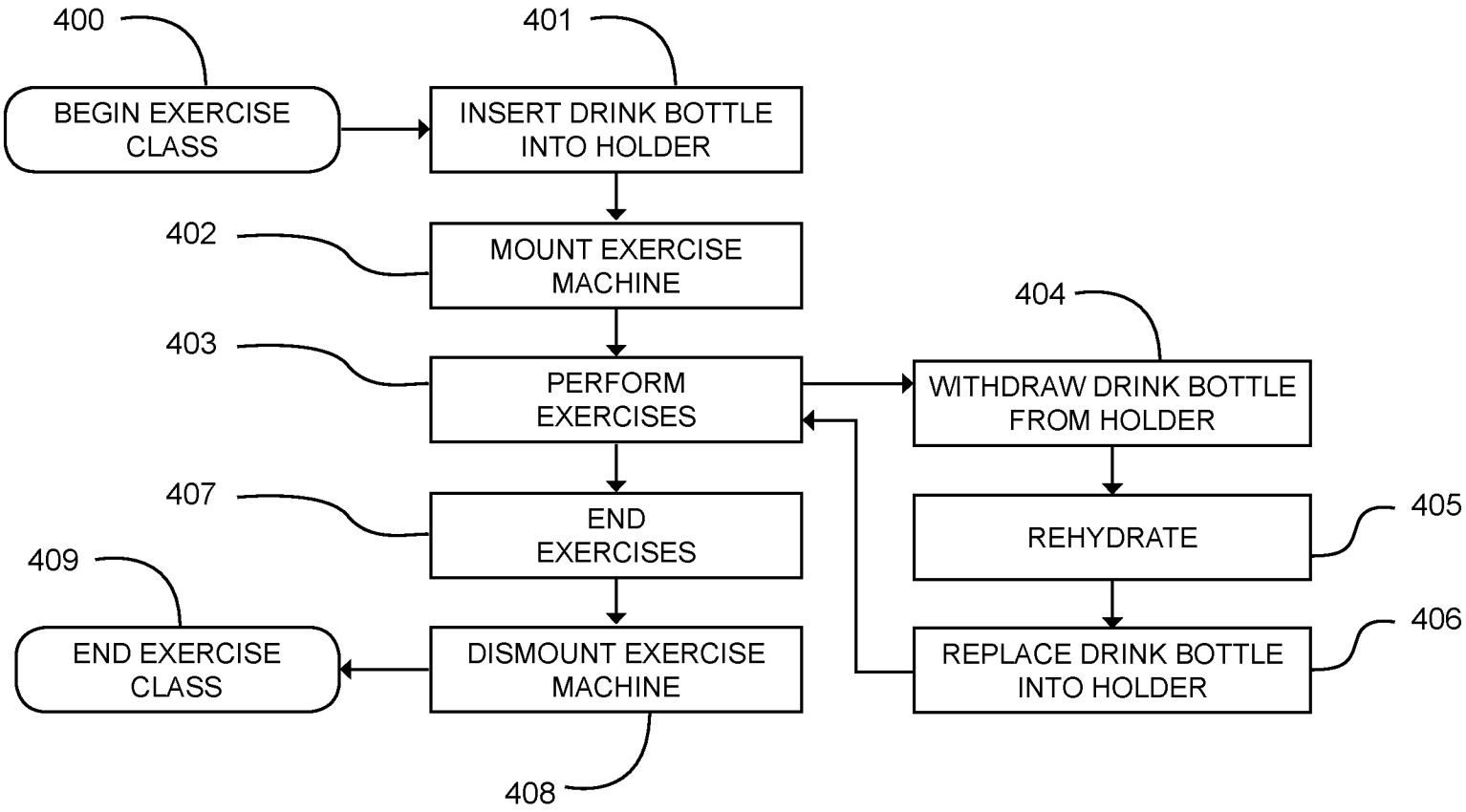
FIG. 12 is a flowchart illustrating use of the exercise machine accessory system in accordance with an example embodiment.

FIG. 12 is an exemplary diagram showing a flow chart of the use of an exercise machine accessory. As previously described, the practical and commercial advantage of the present invention is the elimination of the requirement for an exerciser to stop their exercising to retrieve a water bottle for drinking.

At the time an exerciser begins a class 400, the exerciser stores their water bottle 410 into the holder, mounts the exercise machine 402, and begins the exercise regimen 403. During exercise, and without stopping exercising, the exerciser may retrieve the water bottle 404, take a drink 405, and replace the water bottle in the holder 406, all while continuing to exercise. At the end of the exercise 407, the exerciser dismounts the machine 408 and terminates the exercise period 409.

Figure 13:
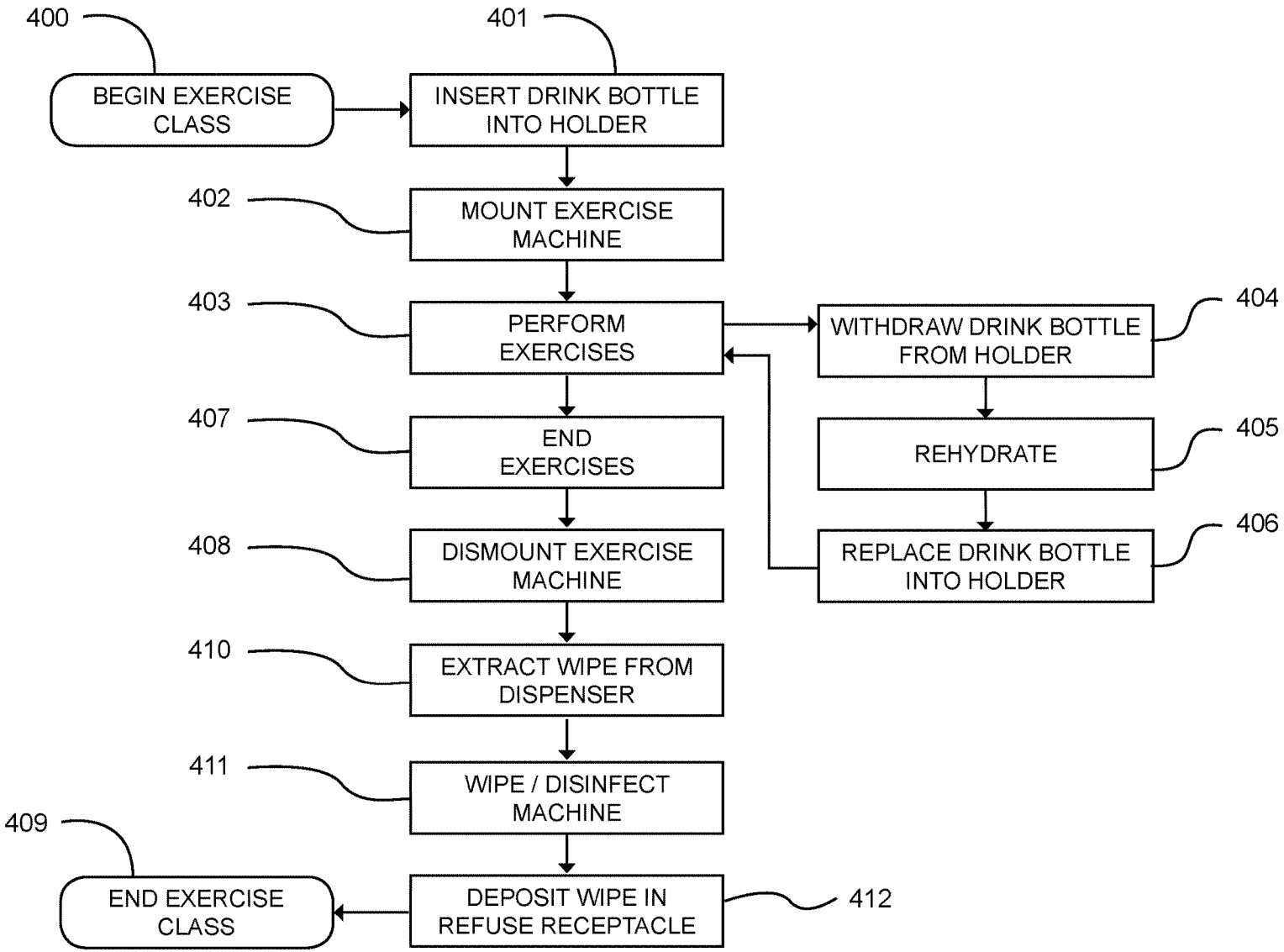
FIG. 13 is a flowchart illustrating use of the exercise machine accessory system in accordance with an example embodiment.

FIG. 13 is an exemplary diagram showing a flow chart of the use of an exercise machine accessory. At the time an exerciser begins a class 400, the exerciser stores their water bottle 410 into the holder, mounts the exercise machine 402, and begins the exercise regimen 403. During exercise, and without stopping exercising, the exerciser may retrieve the water bottle 404, take a drink 405, and replace the water bottle in the holder 406, all while continuing to exercise. At the end of the exercise 407, the exerciser dismounts the machine 408 and extracts an antibacterial wipe from a wipes dispenser 410, wipes down the exercise machine, thereby disinfecting the machine 411, disposes of the used wipe in the refuse dispenser 412, and terminates the exercise period 409.

Figure 14:
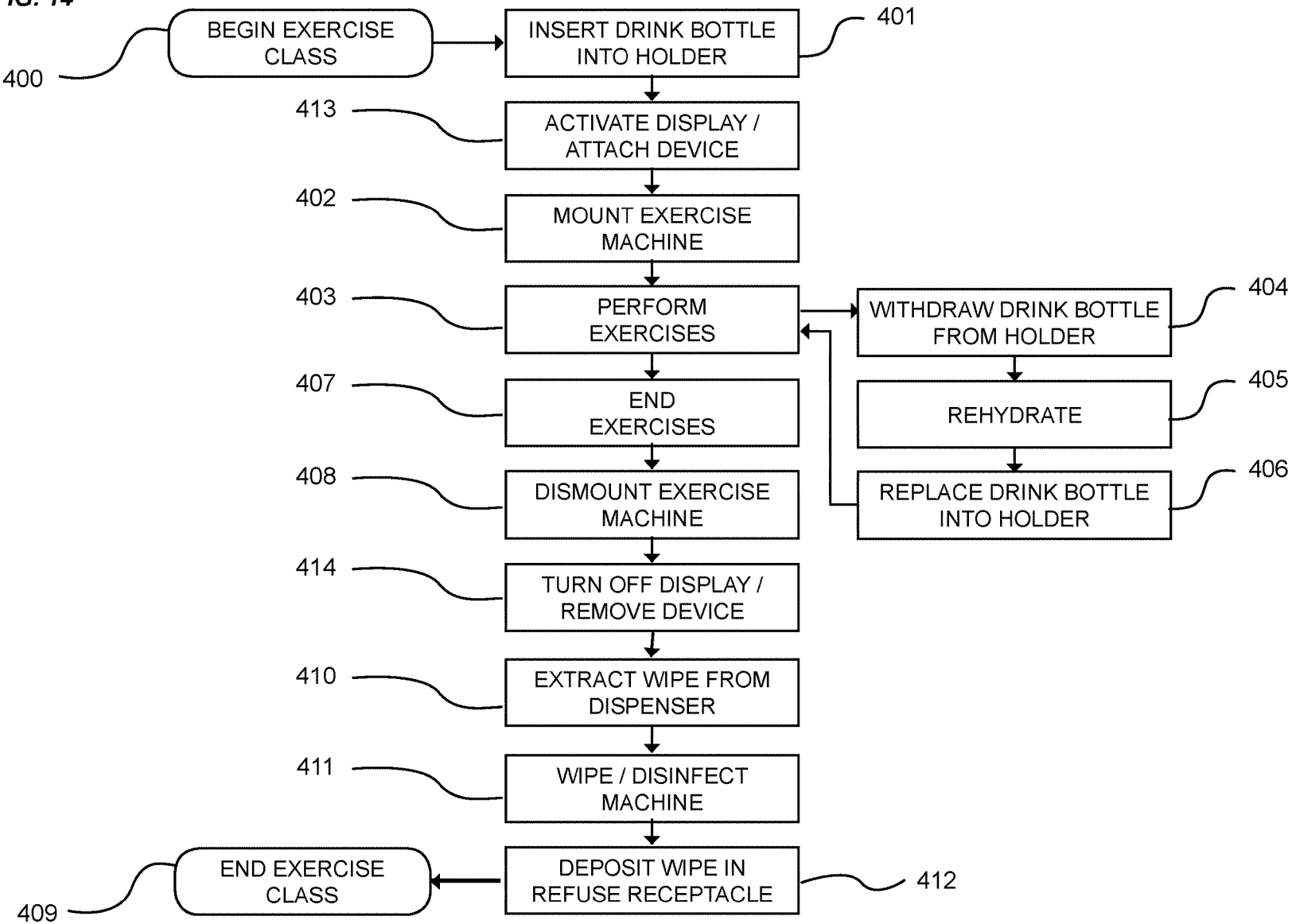
FIG. 14 is a flowchart illustrating use of the exercise machine accessory system in accordance with an example embodiment.

FIG. 14 is an exemplary diagram showing a flow chart of the use of an exercise machine accessory. At the time an exerciser begins a class 400, the exerciser stores their water bottle 410 into the holder, attached a display device, or otherwise activates a display device of the accessory 413, and mounts the exercise machine 402. The exerciser then begins the exercise regimen 403 and during exercise, without stopping exercising, the exerciser may retrieve the water bottle 404, take a drink 405, and replace the water bottle in the holder 406, all while continuing to exercise.

At the end of the exercise 407, the exerciser dismounts the machine 408 and removes their display device or otherwise deactivates a display 414. To prepare the machine for the next exerciser, the exerciser extracts an antibacterial wipe from a wipes dispenser 410, wipes down and disinfects the exercise machine 411, disposes of the used wipe in the refuse dispenser 412, and terminates the exercise period 409.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine accessory system, suitable methods and materials are described above. All publications, patent applications, patents, and other references mentioned herein are incorporated by reference in their entirety to the extent allowed by applicable law and regulations. The exercise machine accessory system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a longitudinal axis extending between a first end and a second end of the frame, wherein the frame includes a rail;

a first stationary exercise platform connected to the frame and positioned near the first end of the frame;

a first right handle connected to the frame and positioned near the first end of the frame, wherein the first right handle is positioned on a right side of the frame;

a first left handle connected to the frame and positioned near the first end of the frame, wherein the first left handle is positioned on a left side of the frame;

a carriage movable along the rail in a reciprocating manner;

a biasing member connected to the carriage, wherein the biasing member provides a resistance force to the carriage;

a first accessory assembly structure having a surface affixed to a surface of the first right handle or the first left handle, wherein the first accessory assembly structure extends outwardly from an exterior side of the first right handle or the first left handle; and a first bottle holder connected to the first accessory assembly structure, wherein the first bottle holder is adapted to removably receive a bottle.

2. The exercise machine of claim 1, including a second accessory assembly structure extending outwardly from an exterior side of the first right handle and a second bottle holder connected to the second accessory assembly structure, wherein the first accessory assembly structure is connected to the first left handle.

3. The exercise machine of claim 1, including:

a second right handle connected to the frame and positioned near the second end of the frame, wherein the second right handle is positioned on a right side of the frame; and a second left handle connected to the frame and positioned near the second end of the frame, wherein the second left handle is positioned on a left side of the frame.

4. The exercise machine of claim 3, a second accessory assembly structure extending outwardly from an exterior side of the second right handle or the second left handle and a second bottle holder connected to the second bracket, wherein the second bottle holder is adapted to removably receive a bottle.

5. The exercise machine of claim 4, wherein the first bottle holder is positioned on the outside of the first right handle or the first left handle, and wherein the second bottle holder is positioned on the outside of the second right handle or the second left handle.

6. The exercise machine of claim 1, wherein the first bottle holder is positioned on the outside of the first right handle or the first left handle.

7. The exercise machine of claim 1, including a first antibacterial wipes dispenser connected to the first right handle or the first left handle, wherein the first antibacterial wipes dispenser is adapted for storing and dispensing a plurality of antibacterial wipes, wherein the first antibacterial wipes dispenser is affixed in a permanent position on the first right handle or the first left handle.

8. The exercise machine of claim 7, wherein the first bottle holder and the first antibacterial wipes dispenser are connected to the same handle.

9. The exercise machine of claim 1, wherein the biasing member is comprised of a spring.

10. The exercise machine of claim 1, including a first disposal receptacle connected to the first right handle or the first left handle, wherein the first disposal receptacle is adapted for receiving waste material, wherein the first disposal receptacle is affixed in a permanent position on the first right handle or the first left handle.

11. The exercise machine of claim 1, including a first antibacterial wipes dispenser connected to the first accessory assembly structure, wherein the first antibacterial wipes dispenser is adapted for storing and dispensing a plurality of antibacterial wipes.

12. The exercise machine of claim 11, wherein the first antibacterial wipes dispenser is connected to the first accessory assembly structure in a movable manner relative to the first right handle or the first left handle.

13. The exercise machine of claim 1, including a first disposal receptacle connected to the first accessory assembly structure, wherein the first disposal receptacle is adapted for receiving waste material.

14. The exercise machine of claim 13, wherein the first disposal receptacle is connected to the first accessory assembly structure in a movable manner relative to the first right handle or the first left handle.

15. The exercise machine of claim 1, wherein the first bottle holder is connected to the first accessory assembly structure in a movable manner relative to the first right handle or the first left handle.

16. An exercise machine, comprising:

a frame having a longitudinal axis extending between a first end and a second end of the frame, wherein the frame includes a rail;

a first stationary exercise platform connected to the frame and positioned near the first end of the frame;

a first right handle connected to the frame and positioned near the first end of the frame, wherein the first right handle is positioned on a right side of the frame;

a first left handle connected to the frame and positioned near the first end of the frame, wherein the first left handle is positioned on a left side of the frame;

a carriage movable along the rail in a reciprocating manner;

a biasing member connected to the carriage, wherein the biasing member provides a resistance force to the carriage;

a first accessory assembly structure having a surface affixed to a surface of the first right handle or the first left handle, wherein the first accessory assembly structure extends outwardly from an exterior side of the first right handle or the first left handle; and a first antibacterial wipes dispenser connected to the first accessory assembly structure, wherein the first antibacterial wipes dispenser is adapted for storing and dispensing a plurality of antibacterial wipes.

17. The exercise machine of claim 16, wherein the first antibacterial wipes dispenser is connected to the first accessory assembly structure in a movable manner relative to the first right handle or the first left handle.

18. The exercise machine of claim 16, including a first disposal receptacle connected to the first accessory assembly structure, wherein the first disposal receptacle is adapted for receiving waste material.

19. The exercise machine of claim 18, wherein the first disposal receptacle is connected to the first accessory assembly structure in a movable manner relative to the first right handle or the first left handle.

20. An exercise machine, comprising:

a frame having a longitudinal axis extending between a first end and a second end of the frame, wherein the frame includes a rail;

a first stationary exercise platform connected to the frame and positioned near the first end of the frame;

a first right handle connected to the frame and positioned near the first end of the frame, wherein the first right handle is positioned on a right side of the frame;

a first left handle connected to the frame and positioned near the first end of the frame, wherein the first left handle is positioned on a left side of the frame;

a carriage movable along the rail in a reciprocating manner;

a biasing member connected to the carriage, wherein the biasing member provides a resistance force to the carriage;

a first accessory assembly structure having a surface affixed to a surface of the first right handle or the first left handle, wherein the first accessory assembly structure extends outwardly from an exterior side of the first right handle or the first left handle;

a first bottle holder connected to the first accessory assembly structure, wherein the first bottle holder is adapted to removably receive a bottle, and wherein the first bottle holder is connected to the first accessory assembly structure in a movable manner relative to the first right handle or the first left handle;

a first antibacterial wipes dispenser connected to the first accessory assembly structure, wherein the first antibacterial wipes dispenser is adapted for storing and dispensing a plurality of antibacterial wipes, and wherein the first antibacterial wipes dispenser is connected to the first accessory assembly structure in a movable manner relative to the first right handle or the first left handle;

a first disposal receptacle connected to the first accessory assembly structure, wherein the first disposal receptacle is adapted for receiving waste material, and wherein the first disposal receptacle is connected to the first accessory assembly structure in a movable manner relative to the first right handle or the first left handle.

* * * * *